US011493251B2

(12) United States Patent
Park et al.

(10) Patent No.: US 11,493,251 B2
(45) Date of Patent: Nov. 8, 2022

(54) ICE MAKER AND REFRIGERATOR HAVING THE SAME

(71) Applicant: SAMSUNG ELECTRONICS CO., LTD., Suwon-si (KR)

(72) Inventors: Kyoungki Park, Suwon-si (KR); Sanggyu Jung, Suwon-si (KR); Jin Jeong, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 95 days.

(21) Appl. No.: 16/891,693

(22) Filed: Jun. 3, 2020

(65) Prior Publication Data

US 2020/0378671 A1 Dec. 3, 2020

(30) Foreign Application Priority Data

Jun. 3, 2019 (KR) ..... 10-2019-0065608

(51) Int. Cl.

| | |
|---|---|
| ***F25C 1/24*** | (2018.01) |
| ***F25C 5/04*** | (2006.01) |
| ***F25C 1/10*** | (2006.01) |

(52) U.S. Cl.

CPC ..... *F25C 1/24* (2013.01); *F25C 1/10* (2013.01); *F25C 5/043* (2013.01)

(58) Field of Classification Search

CPC ..... F25C 1/24; F25C 1/10; F25C 1/25; F25C 5/22; F25C 2305/022; F25C 2400/10; F25C 5/043; F25D 2323/122

See application file for complete search history.

(56) References Cited

U.S. PATENT DOCUMENTS

| | | | | |
|---|---|---|---|---|
| 10,151,525 | B2 | 12/2018 | Shrader et al. | |
| 10,238,209 | B2 | 3/2019 | Ahmedov et al. | |
| 2016/0265831 | A1* | 9/2016 | Hwang | F25D 23/04 |
| 2017/0159986 | A1* | 6/2017 | Hong | F25C 1/04 |

FOREIGN PATENT DOCUMENTS

| | | |
|---|---|---|
| KR | 10-2008-0103350 | 11/2008 |
| KR | 10-2014-0123755 | 10/2014 |
| KR | 10-1575054 | 12/2015 |
| KR | 10-2016-0048401 | 5/2016 |

OTHER PUBLICATIONS

International Search Report dated Sep. 17, 2020 in International Patent Application No. PCT/KR2020/006640.

Extended European Search Report dated Mar. 9, 2022 in European Patent Application No. 20818247.7 (8 pages).

* cited by examiner

*Primary Examiner* — Elizabeth J Martin
*Assistant Examiner* — Samba Nmn Gaye
(74) *Attorney, Agent, or Firm* — Staas & Halsey LLP

(57) ABSTRACT

A refrigerator having an ice maker with an improved structure. The refrigerator includes an ice maker installable in the door, and including a frame, an ice-making tray which is detachably mounted on the frame, configured to contain ice, and a water bucket which is rotatable while mounted on the frame, configured to supply water to the ice-making tray. The water bucket may include a rotating shaft as a rotation center about which the water bucket is rotatable, and a moving guide spaced apart from the rotating shaft and movable around the rotating shaft. The frame may include a rotating shaft coupling portion to which the rotating shaft is rotatably coupled, and a guide rail on which at least a portion of the moving guide is supported, configured to guide a rotational movement of the water bucket.

19 Claims, 16 Drawing Sheets

ICE MAKER AND REFRIGERATOR HAVING THE SAME

CROSS-REFERENCE TO RELATED APPLICATION(S)

This application is based on and claims priority under 35 U.S.C. § 119 to Korean Patent Application No. 10-2019-0065608, filed on Jun. 3, 2019 in the Korean Intellectual Property Office, the disclosure of which is incorporated by reference in its entirety.

FIELD

The disclosure relates to a refrigerator, and more particularly, to a refrigerator having an ice maker with an improved structure.

DESCRIPTION OF RELATED ART

Generally, a refrigerator is an apparatus that stores food in a fresh state by having a main body, a door, a storage chamber formed between the main body and the door to store food, and a cool air supply device for supplying cool air to the storage chamber. The storage chamber includes a refrigerating chamber that stores food refrigerated at approximately 0 to 5 degrees Celsius, and a freezing chamber that stores food frozen at approximately below 0 degree Celsius.

The refrigerator may be equipped with an ice maker that generates ice. The ice maker includes an ice-making tray for generating ice by storing and cooling water, and an ice bucket for storing the ice separated from the ice-making tray.

The ice maker may be divided into an automatic ice maker in which each of a water supply process for watering the ice-making tray, an ice making process for cooling the water stored in the ice-making tray to generate ice, an ice separating process for separating the generated ice from the ice-making tray to the ice bucket, and an ice extraction process for extracting the ice from the ice bucket is performed automatically, and a manual ice maker in which each of the water supply process, the ice making process, the ice separating process, and the ice extraction process is performed manually.

The process of supplying water to the ice-making tray of the manual ice maker includes taking out the ice-making tray from an ice-making tray mounting part, pouring water into the ice-making tray without overflowing, and mounting the ice-making tray in which the water is stored again to the ice-making mounting part.

A water bucket for supplying water to the ice-making tray of the manual ice maker may be mounted. However, when mounting the water bucket, the water may splash or flow, which may cause drawbacks in consumer usability.

The above information is presented as background information only to assist with an understanding of the present disclosure. No determination has been made, and no assertion is made, as to whether any of the above might be applicable as prior art with regard to the present disclosure.

SUMMARY

It is an aspect of the disclosure to provide a refrigerator having an improved ice maker.

It is another aspect of the disclosure to provide a refrigerator having an ice maker with an improved mounting structure of a water bucket.

It is another aspect of the disclosure to provide a refrigerator having an ice maker with an improved mounting structure of an ice-making tray.

Additional aspects of the disclosure will be set forth in part in the description which follows and, in part, will be obvious from the description, or may be learned by practice of the disclosure.

In accordance with an aspect of the disclosure, a refrigerator includes a main body forming a storage chamber; a door configured to open and close the storage chamber; and an ice maker installed in the door, configured to generate ice. The ice maker may include a frame, an ice-making tray which is detachably mounted on the frame, configured to make the ice, and a water bucket provided to be rotatably on the frame, configured to supply water to the ice-making tray. The water bucket may include a rotating shaft that becomes a rotation center of the water bucket when mounted on the frame, and a moving guide spaced apart from the rotating shaft so as to be movable around the rotating shaft. The frame may include a rotating shaft coupling portion to which the rotating shaft is rotatably coupled, and a guide rail supported on at least a portion of the moving guide, configured to guide a rotational movement of the water bucket.

The water bucket may include a water bucket body with one surface opened to supply water, and a water bucket cover formed on one surface of the water bucket body. The rotating shaft and the moving guide may be configured to be provided on both sides of the water bucket body.

The frame may include a water bucket installation portion in which the water bucket is installed. The rotating shaft coupling portion and the guide rail may be configured to be provided on both inner sides of the water bucket installation portion.

The rotating shaft coupling portion and the guide rail may be configured to be formed integrally.

The guide rail may further include a seating portion formed to limit the movement of the moving guide when the water bucket is mounted.

The rotating shaft coupling portion and the guide rail may be configured to be opened in a mounting direction of the water bucket so that the water bucket is separable.

The frame may include a water bucket receiving portion configured to receive the water bucket. The water bucket receiving portion may include an inclined surface configured to be inclined so that the water in the water bucket is guided to the ice-making tray.

The water bucket cover may further include a frame support portion configured to be formed to extend at the bottom thereof and configured to be supported on at least one surface of the water bucket installation portion.

The refrigerator may further include a lever configured to be manipulated to separate the ice from the ice-making tray. The ice-making tray may include a mounting guide configured to guide engagement with the lever.

The lever may include a connecting member provided with a shaft inserting portion to rotatably connect the ice-making tray.

The ice-making tray may include a shaft portion connected to the shaft inserting portion of the lever, and a rotating shaft portion rotatably connected to the frame. The mounting guide may be configured to be provided on the shaft portion.

The shaft portion may include an elliptical first shaft, and an elliptical second shaft spaced apart from the first shaft. The mounting guide may be configured to connect between the first shaft and the second shaft.

The first shaft has a first height h1. The second shaft has a second height h2 higher than the first height. The mounting guide is formed to a third height h3 lower than the first height.

The frame may further include an ice-making cover configured to cover the ice-making tray, and a cover rotating shaft configured to be provided to couple the ice-making cover. The ice-making cover may include a cover rotating hole formed to be movably coupled in a vertical direction with respect to the cover rotating shaft.

The ice-making cover may be configured to be provided to be movable in the vertical direction along the cover rotating hole coupled to the cover rotating shaft. When the cover rotating hole is located at a first position of the cover rotating shaft, the ice-making cover may be configured to be rotatable around the cover rotating shaft. When the cover rotating hole is located at a second position of the cover rotating shaft, the ice-making cover may be configured to be fixed to the frame.

In accordance with another aspect of the disclosure, a refrigerator includes a main body configured to be provided with a storage chamber; a door provided in the main body, configured to open and close the storage chamber; and an ice maker mounted on the door. The ice maker may include a frame, an ice-making tray including a shaft portion provided on one side and a rotating shaft portion provided on the other side, configured to be detachably mounted on the frame, and a lever connected to the ice-making tray, configured to be manipulated to separate ice from the ice-making tray. The lever may include a connecting member provided with a shaft inserting portion, configured to rotatably connect the ice-making tray. The ice-making tray may include a mounting guide provided on the shaft portion, configured to guide engagement with the lever.

The shaft portion may include an elliptical first shaft, and an elliptical second shaft spaced apart from the first shaft. The mounting guide may be configured to connect between the first shaft and the second shaft.

The first shaft has a first height h1, the second shaft has a second height h2 higher than the first height, and the mounting guide is formed to a third height h3 lower than the first height. The first height, the second height, and the third height may be configured to be formed at different heights.

The refrigerator may further include a water bucket provided to be rotatably on the frame, configured to supply water to the ice-making tray. The water bucket may include a rotating shaft that becomes a rotation center of the water bucket when mounted on the frame, and a moving guide spaced apart from the rotating shaft so as to be movable around the rotating shaft. The frame may include a rotating shaft coupling portion to which the rotating shaft is rotatably coupled, and a guide rail supported on at least a portion of the moving guide, configured to guide a rotational movement of the water bucket.

The rotating shaft coupling portion and the guide rail may be configured to be formed integrally.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
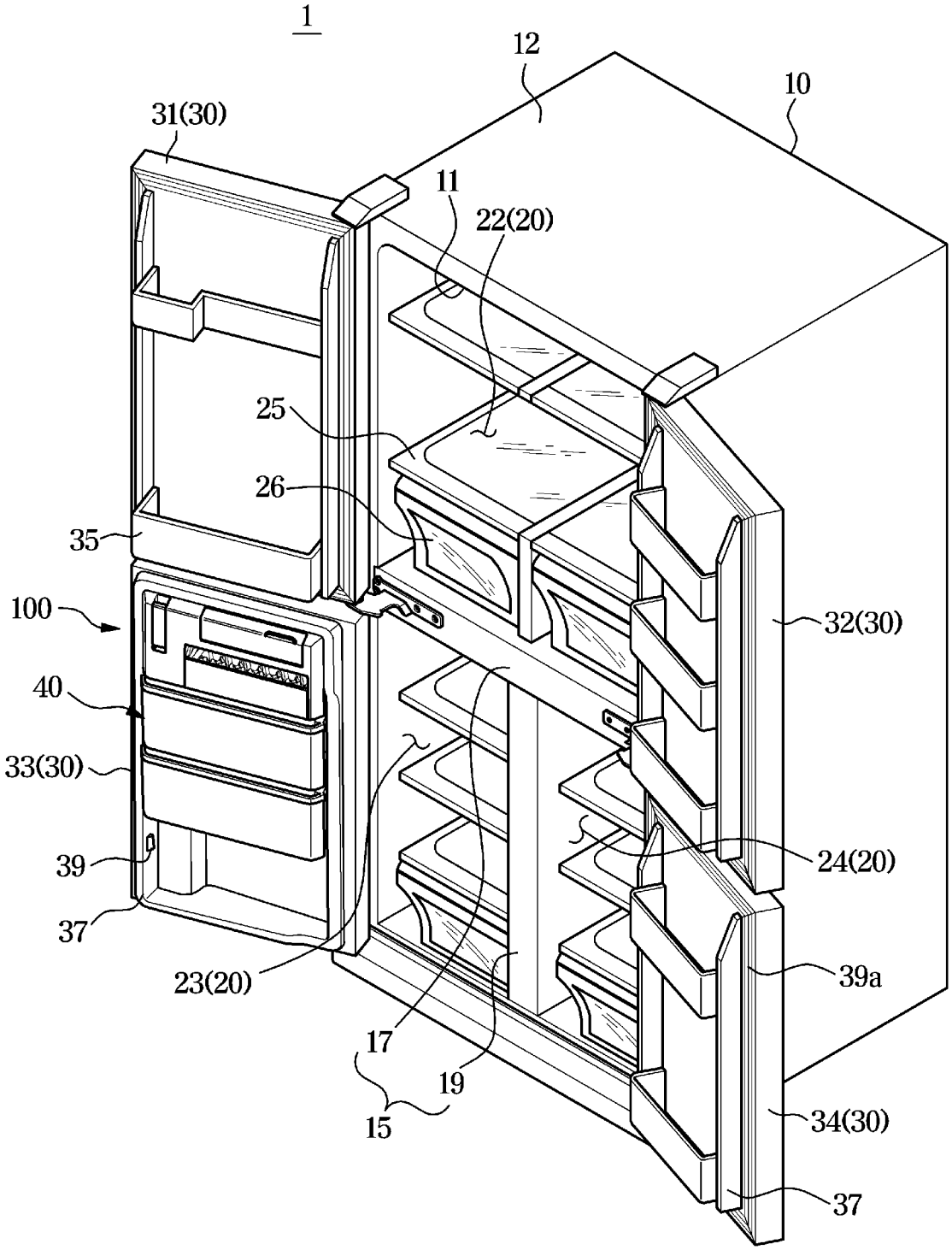
FIG. 1 is a view illustrating a refrigerator equipped with an ice maker according to an embodiment of the disclosure.

The following description with reference to the accompanying drawings is provided to assist in the comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable clear and consistent understanding of the present disclosure. Accordingly, it should be apparent to those skilled in the art that the following description of various embodiments of the present disclosure is only provided for illustrative purposes and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Configurations illustrated in various embodiments and the drawings described in the present specification are only various embodiments, and thus it is to be understood that various modified examples, which may replace or modify various embodiments described in the present specification, are possible.

Also, like reference numerals or symbols provided in the drawings of the present specification represent members or components that perform substantially the same functions.

It will be understood that the terms "includes," "comprises," "including," and/or "comprising," when used in this specification, specify the presence of stated features, figures, operations, components, or combinations thereof, but do not preclude the presence or addition of one or more other features, figures, operations, components, members, or combinations thereof.

It will be understood that, although the terms first, second, etc. may be used herein to describe various components, these components should not be limited by these terms. These terms are only used to distinguish one component from another. For example, a first component could be termed a second component, and, similarly, a second component could be termed a first component, without departing from the scope of the present disclosure. As used herein, the term "and/or" includes any and all combinations of one or more of associated listed items.

Hereinafter, embodiments of the disclosure will be described in detail with reference to the accompanying drawings.

The terms "front-end," "rear-end," "upper portion," "lower portion," "upper end," "lower end," and the like used in the below descriptions are defined based on the drawings, and the shape and position of each component are not limited to the terms.

A front surface and a front side used below refer to the front surface and the front side facing directions based on a refrigerator 1 illustrated in FIG. 1, and a rear side refers to a direction toward the rear side of the refrigerator 1.

FIG. 1 is a view illustrating a refrigerator equipped with an ice maker according to an embodiment of the disclosure.

Referring to FIG. 1, the refrigerator 1 may include a main body 10, a storage chamber 20 formed by being divided vertically inside the main body 10, a door 30 for opening and closing the storage chamber 20, and a cool air supply device (not shown) for supplying cool air to the storage chamber 20.

The main body 10 may include an inner case 11 forming the storage chamber 20, an outer case 12 coupled to the outside of the inner case 11 to form an appearance of the refrigerator 1, and a heat insulating material (not shown) foamed between the inner case 11 and the outer case 12 to insulate the storage chamber 20.

The cool air supply device may generate cool air using a cooling cycle in which a refrigerant is compressed, condensed, expanded, and evaporated.

The storage chamber 20 may be divided into a plurality of partitions 15, and a plurality of shelves 25 and storage containers 26 may be provided inside the storage chamber 20 to store food and the like.

The storage chamber 20 may be divided into a plurality of storage chambers 22, 23, and 24 by the partition 15. The partition 15 may include a first partition 17 that is horizontally coupled to an interior of the storage chamber 20 to divide the storage chamber 20 into the upper storage chamber 22 (or first storage chamber) and the lower storage chambers 23 and 24, and a second partition 19 that is vertically coupled to the lower storage chambers 23 and 24 to divide the lower storage chambers 23 and 24 into the second storage chamber 23 and the third storage chamber 24.

The partition 15 having a T-shaped by combining the first partition 17 and the second partition 19 may divide the storage chamber 20 into three spaces. The upper storage chamber 22 divided by the first partition 17 may be used as a refrigerating chamber. The lower storage chambers 23 and 24 divided by the first partition 17 may be used as a freezing chamber.

The lower storage chambers 23 and 24 may be used as the entire freezing chamber. However, the second storage chamber 23 may be used as the freezing chamber, and the third storage chamber 24 may be used as the refrigerating chamber or the second storage chamber 23 may be used as the freezing chamber, and the third storage chamber 24 may be used as both the freezing chamber and the refrigerating chamber.

The above-described division of the storage chamber 20 is one example, and each of the storage chambers 22, 23, and 24 may be used differently from the above description.

The storage chamber 20 may be opened and closed by the door 30. The door 30 may include a pair of first and second doors 31 and 32 (or upper doors) that open and close the upper storage chamber 22, and a pair of agents that open and close the lower storage chambers 23 and 24. The door 30 may also include a pair of third and fourth doors 33 and 34 (or lower doors).

The pair of upper doors 31 and 32 and the pair of lower doors 33 and 34 may open and close an opening of the opened main body 10.

Hereinafter, only the one third door 33 will be described for convenience of description, and descriptions of the remaining first door 31, the second door 32, and the fourth door 34 will be omitted.

The lower storage chamber 23 may be opened and closed by the third door 33 rotatably coupled to the main body 10. At this time, the lower storage chamber 23 may be used as the freezing chamber. The third door 33 may be opened and closed through a third door handle (not shown). The third door handle may be recessed on an upper surface of the third door 33.

A door shelf 35 for placing food may be provided on a rear surface of the third door 33. The door shelf 35 may include a shelf support portion 37 extending vertically from the third door 33 to support the door shelf 35 on both left and right sides of the door shelf 35. A gasket 39*a* may be provided on a rear edge of the third door 33 to seal a gap with the main body 10 in a state where the third door 33 is closed. The gasket 39*a* may be installed on the rear surface of the third door 33 in a loop shape along the edge, and a first magnet (not shown) may be included therein.

An ice maker 100 may be mounted on an inner surface of at least one of the third door 33 or the fourth door 34. For example, the ice maker 100 may be mounted on the inner surface of the third door 33.

Figure 2:
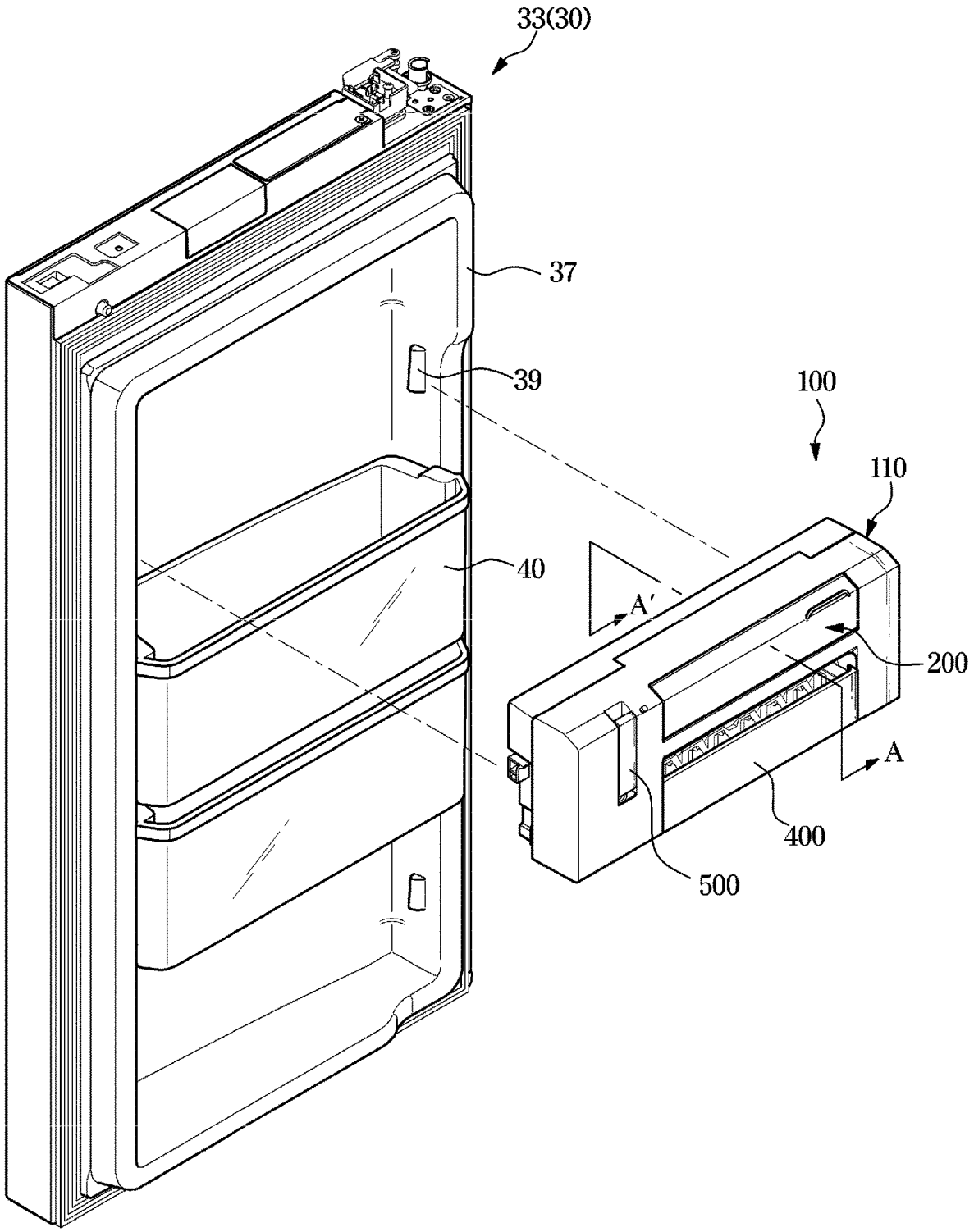
FIG. 2 is a view illustrating an ice maker mounted on a refrigerator door according to an embodiment of the disclosure.
Figure 3:
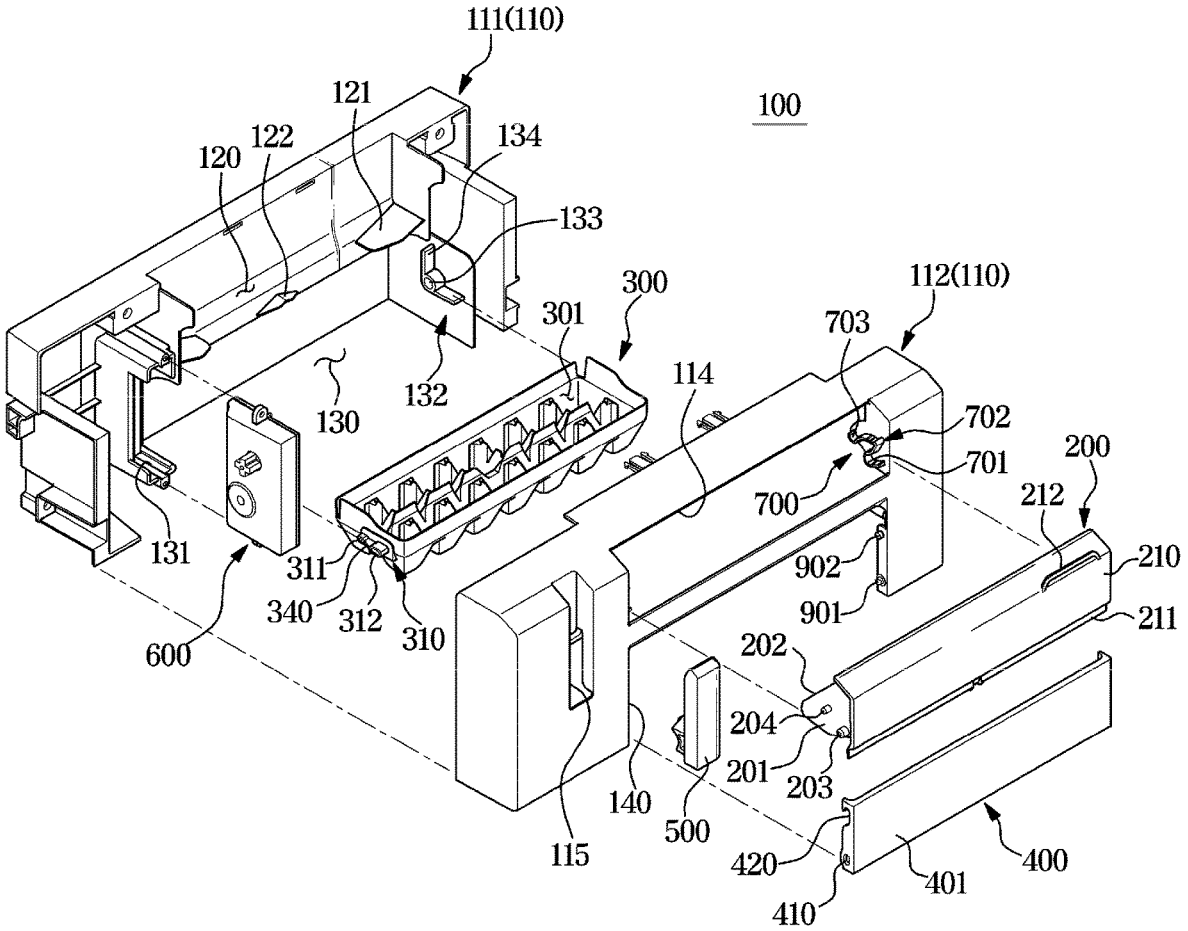
FIG. 3 is an exploded perspective view illustrating an ice maker according to an embodiment of the disclosure.
Figure 4:
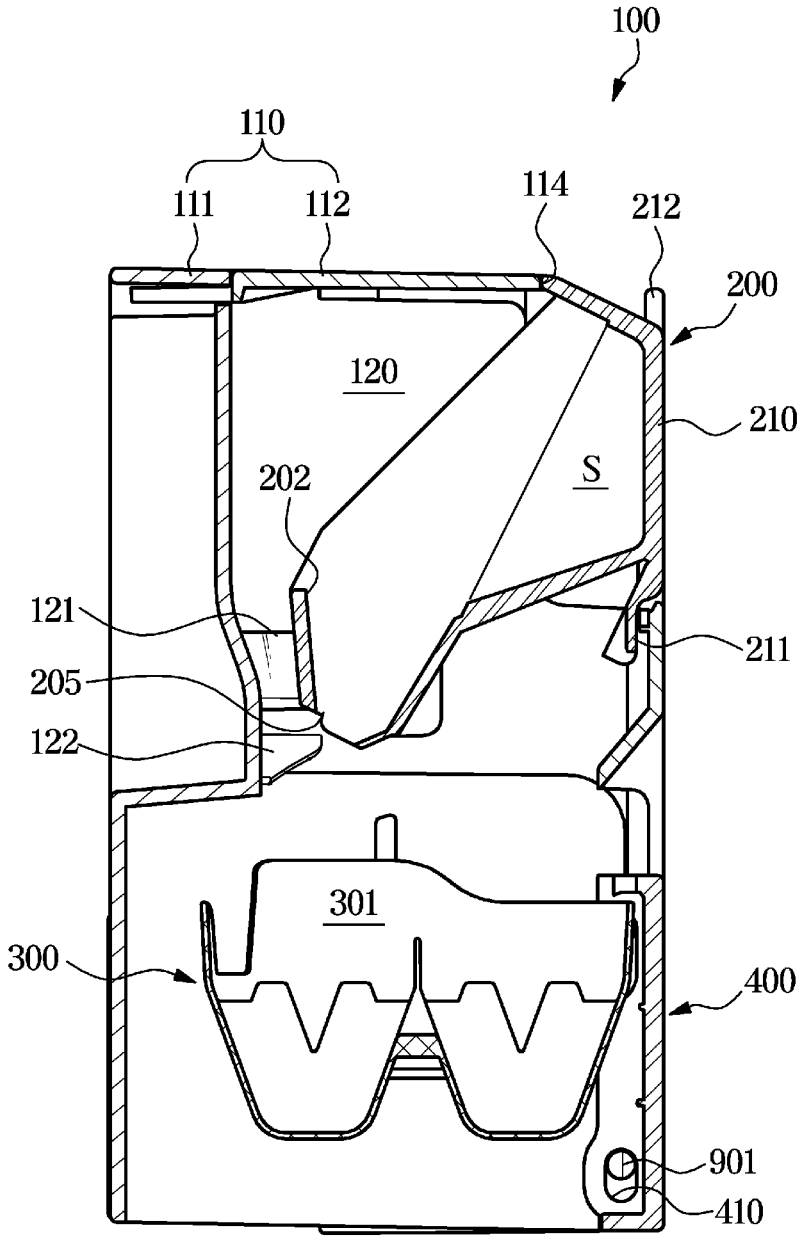
FIG. 4 is a cross-sectional view of part A-A' of FIG. 2 illustrating an ice maker according to an embodiment of the disclosure.

FIG. 2 is a view illustrating an ice maker mounted on a refrigerator door according to an embodiment of the disclosure, FIG. 3 is an exploded perspective view illustrating an ice maker according to an embodiment of the disclosure, and FIG. 4 is a cross-sectional view of part A-A' of FIG. 2 illustrating an ice maker according to an embodiment of the disclosure.

As illustrated in FIGS. 2 to 4, the ice maker 100 may be mounted on the third door 33 (hereinafter referred to as "door"). A plurality of mounting protrusions 39 may be provided on the inner surface of the shelf support portion 37 of the door 30. The mounting protrusions 39 may be formed to protrude from the inner surface of the shelf support portion 37. The mounting protrusions 39 may be located spaced apart at predetermined intervals in a vertical direction of the shelf support portion 37. The ice maker 100 may be installed by the mounting protrusions 39 provided on the door 30. The ice maker 100 may be provided with a locking structure corresponding to the mounting protrusions 39. A basket 40 may be located under the ice maker 100 so that ice formed from the ice maker 100 can be stored.

The ice maker 100 may include frames 110, an ice-making tray 300 where water is supplied to form ice, and a water bucket 200 provided to supply water to the ice-making tray 300.

The frames 110 may include a first frame 111 provided to be mounted on the door 30 and a second frame 112 coupled to the first frame 111.

The first frame 111 and the second frame 112 may be provided in combination with each other, and the water bucket 200 and the ice-making tray 300 may be detachably installed in an inner space formed by the combination of the first frame 111 and the second frame 112. The water bucket 200 may be located on top of the ice-making tray 300. The ice-making tray 300 may be mounted on the first frame 111. The water bucket 200 may be mounted on the second frame 112.

At least one of the first frame 111 or the second frame 112 may be provided with a lever 500 that is manually operated to separate the ice of the ice-making tray 300. The lever 500 may be connected to the ice-making tray 300 through a connecting member 600. The lever 500 may be provided to be tiltable, and a user may separate the ice from the ice-making tray 300 by tilting the lever 500. The ice separated from the ice-making tray 300 may be stored by falling to the basket 40 provided at the bottom.

A water bucket receiving portion 120 through which water in the water bucket 200 flows may be provided on an upper portion of the first frame 111. The water bucket receiving portion 120 may be provided on the first frame 111. A water bucket installation portion 114 formed at a position corresponding to the water bucket receiving portion 120 may be provided in the second frame 112. The water bucket installation portion 114 may be formed to communicate with the water bucket receiving portion 120. The water bucket installation portion 114 may be provided on an upper portion of the second frame 112. The water of the water bucket 200 installed through the water bucket installation portion 114 may be supplied to the ice-making tray 300 through the water bucket receiving portion 120.

The water bucket receiving portion 120 may include an inclined surface 121 that is inclined to guide water supplied from the water bucket 200 to the ice-making tray 300. The inclined surface 121 may be formed to be inclined from the top to the bottom center. The water bucket receiving portion 120 may be formed in a shape corresponding to a size of the water bucket 200. The water bucket receiving portion 120 may be formed in a shape corresponding to a size of the ice-making tray 300. At least a portion of the inclined surface 121 may be formed to be inclined in a different direction from the inclined surface 121 to include a distribution surface 122 for uniformly distributing water to the ice-making tray 300.

The water supplied from the water bucket 200 may be uniformly supplied to the ice-making tray 300 through the inclined surface 121 and the distribution surface 122 of the water bucket receiving portion 120.

A tray installation portion 130 in which the ice-making tray 300 is installed may be provided in the first frame 111. The tray installation portion 130 may be provided under the water bucket receiving portion 120 of the first frame 111. A connecting member installation portion 131 in which the lever 500 and the connecting member 600 are installed may be provided on one side of the first frame 111 forming the tray installation portion 130, and the other side of the first frame 111 may be provided with a rotating shaft mounting portion 132 that is provided so that the ice-making tray 300 can be rotatably mounted. The ice-making tray 300 may be rotatably installed by the connecting member 600 and the rotating shaft mounting portion 132 installed in the connecting member installation portion 131 of the tray installation portion 130.

The ice-making tray 300 may be provided with an ice-making portion 301, which is a space in which water is received and ice is made. A rotating shaft portion 320 may be provided on one side of the ice-making tray 300 and a shaft portion 310 may be provided on the other side of the ice-making tray 300. The rotating shaft portion 320 and the shaft portion 310 may be formed to protrude on one side and the other side of the ice-making tray 300.

The rotating shaft portion 320 of the ice-making tray 300 may be coupled to the first frame 111, and the shaft portion 310 may be coupled to the connecting member 600 of the lever 500. A specific configuration of the shaft portion 310 and the rotating shaft portion 320 of the ice-making tray 300 will be described later.

The rotating shaft portion 320 of the ice-making tray 300 may be coupled to the rotating shaft mounting portion 132 of the first frame 111. The shaft portion 310 of the ice-making tray 300 may be coupled to the connecting member 600 of the lever 500.

The rotating shaft portion 320 of the ice-making tray 300 may be mounted on the rotating shaft mounting portion 132 of the first frame 111. The rotating shaft mounting portion 132 may include a rotating shaft mounting groove 133 so that the rotating shaft portion 320 can be rotatably inserted. The rotating shaft mounting portion 132 may further include a stopper 134 that restricts movement of at least a portion of the rotating shaft portion 320. The stopper 134 may be provided in a stepped shape to prevent one side of the ice-making tray 300 from rotating over a predetermined angle.

The second frame 112 may be coupled to the front of the first frame 111. In the second frame 112, the water bucket installation portion 114 in which the water bucket 200 is installed and a cover installation portion 140 in which an ice-making cover 400 provided to cover the ice-making tray 300 is installed may be formed. The water bucket installation portion 114 may be formed at a position corresponding to the water bucket receiving portion 120 of the first frame 111. The cover installation portion 140 may be formed at a position corresponding to the tray installation portion 130 of the first frame 111. The cover installation portion 140 may be formed under the water bucket installation portion 114.

The water bucket installation portion 114 may be formed by opening the front upper side of the second frame 112. The water bucket installation portion 114 may be formed so that the water bucket 200 can be mounted on the front upper side of the second frame 112. The water bucket 200 may be rotatably installed in the water bucket installation portion 114. The water bucket installation portion 114 may be provided with a moving guide portion 700 that guides the water bucket 200 to be rotatable. The moving guide portion 700 may include a rotating shaft coupling portion 701 rotatably supporting the water bucket 200 and a guide rail 702 rotatably supporting the water bucket 200.

The water bucket 200 may be separated from the second frame 112 as needed. The water bucket 200 may be installed detachably from the water bucket installation portion 114.

The lever 500 may be mounted on the second frame 112. The lever 500 may be mounted in front of the second frame 112. The second frame 112 may be provided with a lever receiving portion 115 in which the lever 500 can be received.

The water bucket 200 may include a water bucket body 201 having one surface opened to supply water illustrated as an opening 202 (FIG. 3), and a water bucket cover 210 formed on at least one surface of the water bucket body 201. The water bucket cover 210 may be formed to a size corresponding to the water bucket installation portion 114. The water bucket cover 210 may include a frame support portion 211 extending at the bottom and supported on at least one surface of the water bucket installation portion 114. It is supported on the inner surface of the second frame 112 by the frame support portion 211 to stably support the lower portion of the water bucket cover 210.

The water bucket body 201 may form a receiving portion S so that water can be stored therein. A drain port 205 may be formed on at least one side of the water bucket body 201 so that the water in the receiving portion S is discharged. The drain port 205 may be formed to face the lower side when the water bucket 200 is mounted on the water bucket installation portion 114.

The cover installation portion 140 formed by opening the ice-making tray 300 to be drawn in and out may be formed in the second frame 112. The cover installation portion 140 may be disposed under the water bucket installation portion 114.

Figure 5:
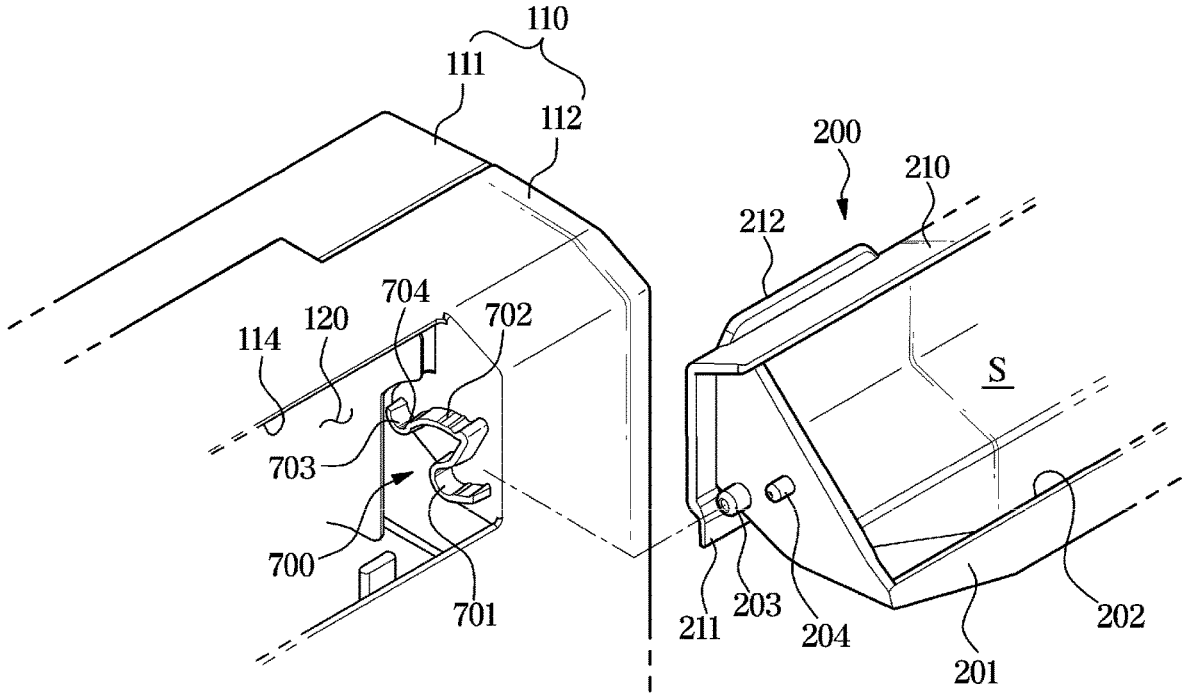
FIG. 5 is a perspective view illustrating a water bucket mounted on a mounting guide portion according to an embodiment of the disclosure.
Figure 6:
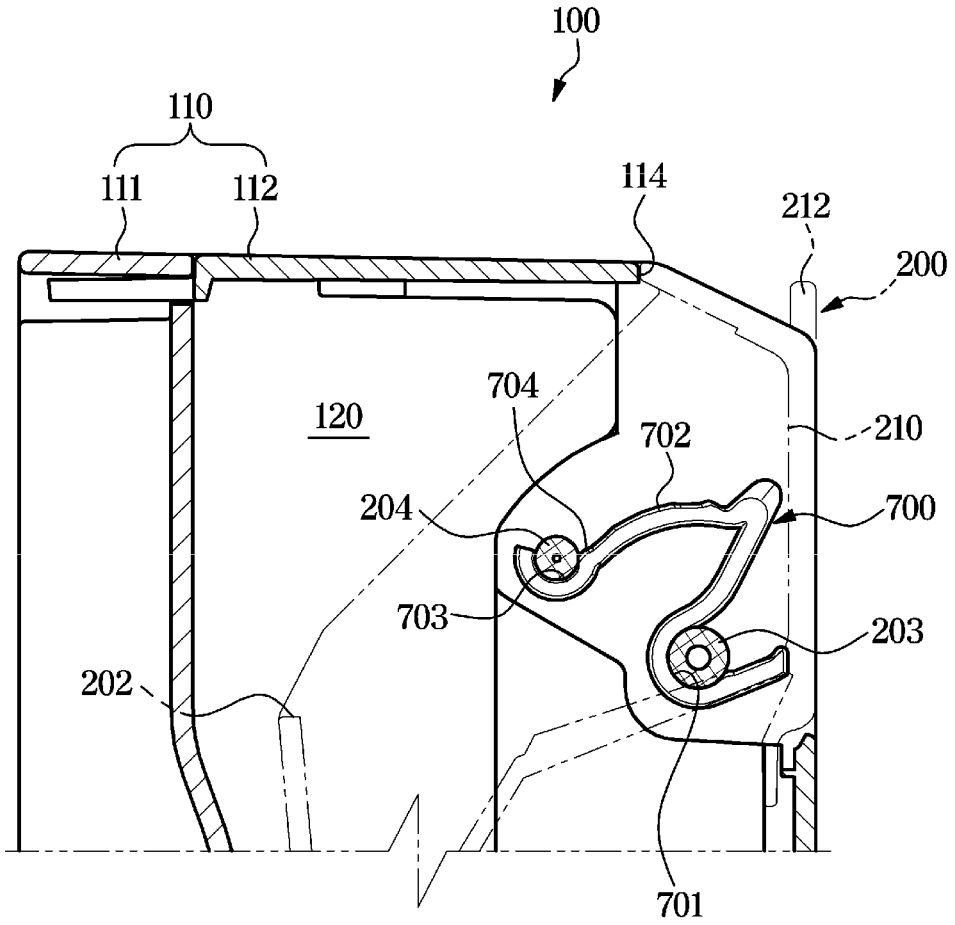
FIG. 6 is a view illustrating a closed state of a water bucket mounted on a mounting guide portion according to an embodiment of the disclosure.
Figure 7:
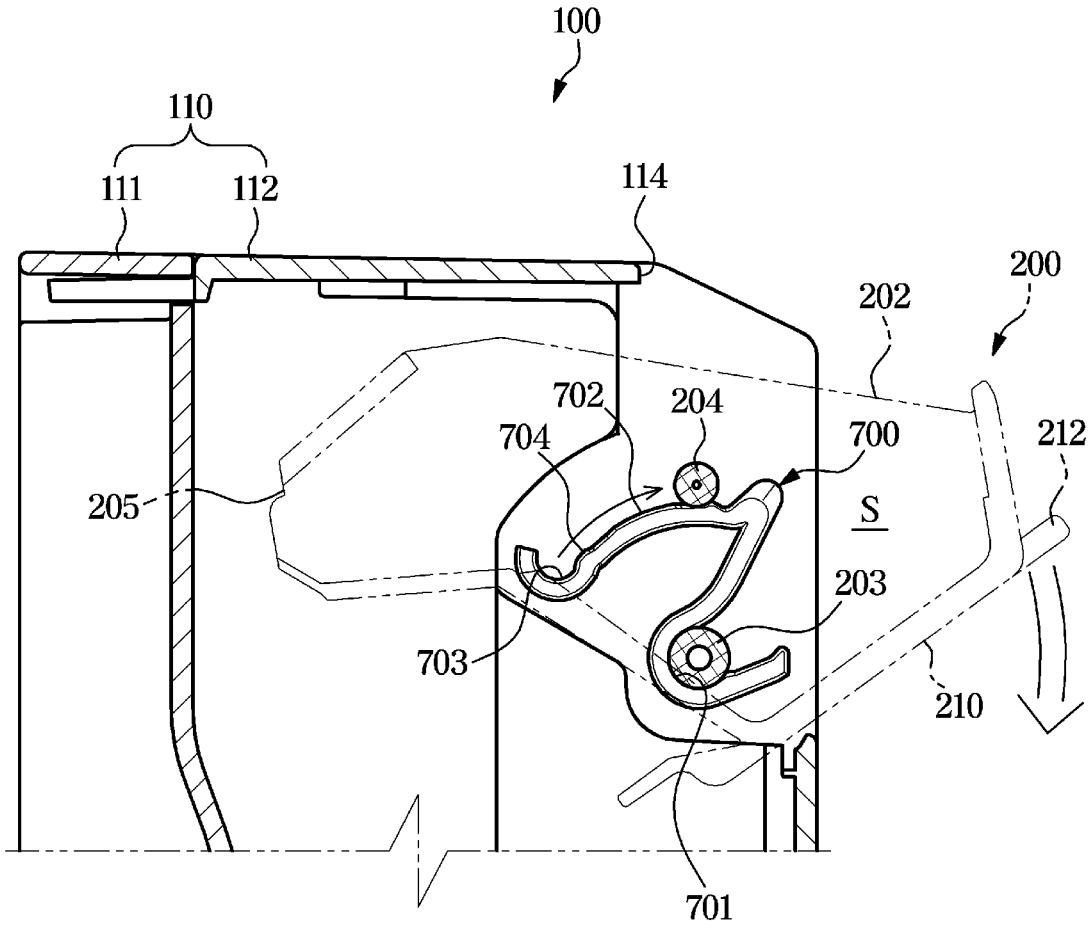
FIG. 7 is a view illustrating an open state of a water bucket mounted on a mounting guide portion according to an embodiment of the disclosure.

FIG. 5 is a perspective view illustrating a water bucket mounted on a mounting guide portion according to an embodiment of the disclosure, FIG. 6 is a view illustrating a closed state of a water bucket mounted on a mounting guide portion according to an embodiment of the disclosure, and FIG. 7 is a view illustrating an open state of a water bucket mounted on a mounting guide portion according to an embodiment of the disclosure.

As illustrated in FIGS. 5 to 7, the water bucket 200 may be detachably mounted on the water bucket installation portion 114.

The water bucket 200 may include the water bucket body 201 and the water bucket cover 210 formed on the front surface of the water bucket body 201.

A handle 212 may be rotatably provided at the top of the water bucket cover 210 for the user to open and close the water bucket 200.

On both sides of the water bucket body 201, a rotating shaft 203 and a moving guide 204 may be provided. The rotating shaft 203 may be a rotation center of the water bucket 200. The rotating shaft 203 may be the rotation center of the water bucket 200 when the water bucket 200 is mounted on the frames 110. The moving guide 204 may be disposed spaced apart from the rotating shaft 203 so that the water bucket 200 is movable around the rotating shaft 203.

The water bucket 200 may be tiltably moved from the water bucket installation portion 114 of the frames 110 by the rotating shaft 203 and the moving guide 204. The rotating shaft 203 of the water bucket 200 and the moving guide 204 may be injection molded integrally with the water bucket 200.

The rotating shaft 203 of the water bucket 200 and the moving guide portion 700 corresponding to the moving guide 204 may be provided in the water bucket installation portion 114 of the frames 110. The moving guide portion 700 may include the rotating shaft coupling portion 701 in which the rotating shaft 203 of the water bucket 200 is rotatably coupled, and the guide rail 702 provided to guide the movement of the water bucket 200 by supporting at least a portion of the moving guide 204.

The rotating shaft coupling portion 701 of the moving guide portion 700 and the guide rail 702 may be integrally injection molded. The rotating shaft coupling portion 701 and the guide rail 702 may be connected and formed integrally.

The guide rail 702 may be provided so that the moving guide 204 provided in the water bucket 200 can be supported when the water bucket 200 is moved. The guide rail 702 may be provided in a bent rib shape. The guide rail 702 may be provided in a movement path of the water bucket 200. One side of the guide rail 702 may include a seating portion 703 formed to allow the moving guide 204 to be seated. The seating portion 703 may be disposed at one end of the guide rail 702.

A locking jaw 704 may be formed on at least a portion of the guide rail 702. The locking jaw 704 may be formed to identify the position of the water bucket 200 when entering or withdrawing the water bucket 200. The locking jaw 704 may be formed to stably move the water bucket 200. In the embodiment of the disclosure, for example, the locking jaw 704 is formed near the seating portion 703 of the guide rail 702, but the spirit of the disclosure is not limited thereto.

The rotating shaft coupling portion 701 of the frames 110 and the guide rail 702 may be provided so that the water bucket 200 can be tilted and detachably mounted. The rotating shaft coupling portion 701 and the guide rail 702 may be formed to open in a coupling direction of the water bucket 200 so that the water bucket 200 is detachably coupled. The rotating shaft 203 of the water bucket 200 and the moving guide 204 may be provided through the rotating shaft coupling portion 701 and an open side of the guide rail 702 to allow entry and exit.

The rotating shaft coupling portion 701 of the frames 110 may be provided so that the rotating shaft 203 of the water bucket 200 is inserted and rotated without linear movement. The rotating shaft coupling portion 701 of the frames 110 and the guide rail 702 are illustrated to be formed integrally by being connected to each other, but the spirit of the disclosure is not limited thereto. For example, the rotating shaft coupling portion 701 and the guide rail 702 may be formed separately.

The rotating shaft 203 of the water bucket 200 is inserted into the rotating shaft coupling portion 701 of the frames 110 to be rotatable. The moving guide 204 of the water bucket 200 may be supported along the guide rail 702 of the frames 110 so that the moving guide 204, that is, the water bucket 200, moves along the guide rail 702 to open and close the water bucket 200.

The water bucket 200 may be detachably mounted from the second frame 112. The water bucket 200 may be detachably mounted from the water bucket installation portion 114. The user may completely separate the water bucket 200 from the second frame 112 as needed. For example, the user may separate the water bucket 200 from the water bucket installation portion 114 of the second frame 112 in the case of washing of the water bucket 200.

Referring to FIGS. 6 and 7, the user may supply water to the ice-making tray 300 through the water bucket 200.

The water bucket 200 may be provided closed to the water bucket installation portion 114 of the frames 110. At this time, the rotating shaft 203 of the water bucket 200 may be coupled to the rotating shaft coupling portion 701 of the water bucket installation portion 114, and the moving guide 204 may be provided in a state seated on the seating portion 703 of the guide rail 702.

When supplying water to the ice-making tray 300, the user may open the water bucket 200 by moving the handle 212 of the water bucket 200 downward. The user may tilt the water bucket 200 using the handle 212 of the water bucket 200.

The water bucket 200 may rotate around the rotating shaft 203. The moving guide 204, which is disposed spaced apart from the rotating shaft 203, is supported by the guide rail 702 and moves forward of the frames 110 along the guide rail 702. The moving guide 204 of the water bucket 200 may move along the guide rail 702 in an outer direction of the frames 110.

An indicator line (not shown) may be formed in the water bucket 200 to supply an appropriate amount of water to the ice-making tray 300. The user may supply water to reach the indicator line of the water bucket 200.

When water is supplied to the water bucket 200, the water bucket 200 may be moved in an inner direction of the frames 110. At this time, the water bucket 200 may rotate around the rotating shaft 203 and the moving guide 204 may move in the inner direction of the water bucket 200 along the guide rail 702.

When the moving guide 204 of the water bucket 200 is seated on the seating portion 703 of the guide rail 702, the water bucket 200 is completely closed to the water bucket installation portion 114. The water in the water bucket 200 may be discharged through the drain port 205. The water drained through the drain port 205 of the water bucket 200 may be supplied to the ice-making tray 300 along the inclined surface 121 of the first frame 111.

Through the water bucket 200 provided in the ice maker 100, the appropriate amount of water may be uniformly supplied to the ice-making tray 300.

In addition, the water bucket 200 may be stably rotated and supported along the rotating shaft coupling portion 701 and the guide rail 702 of the frames 110 by the configuration of the rotating shaft 203 and the moving guide 204 to improve usability.

Figure 8:
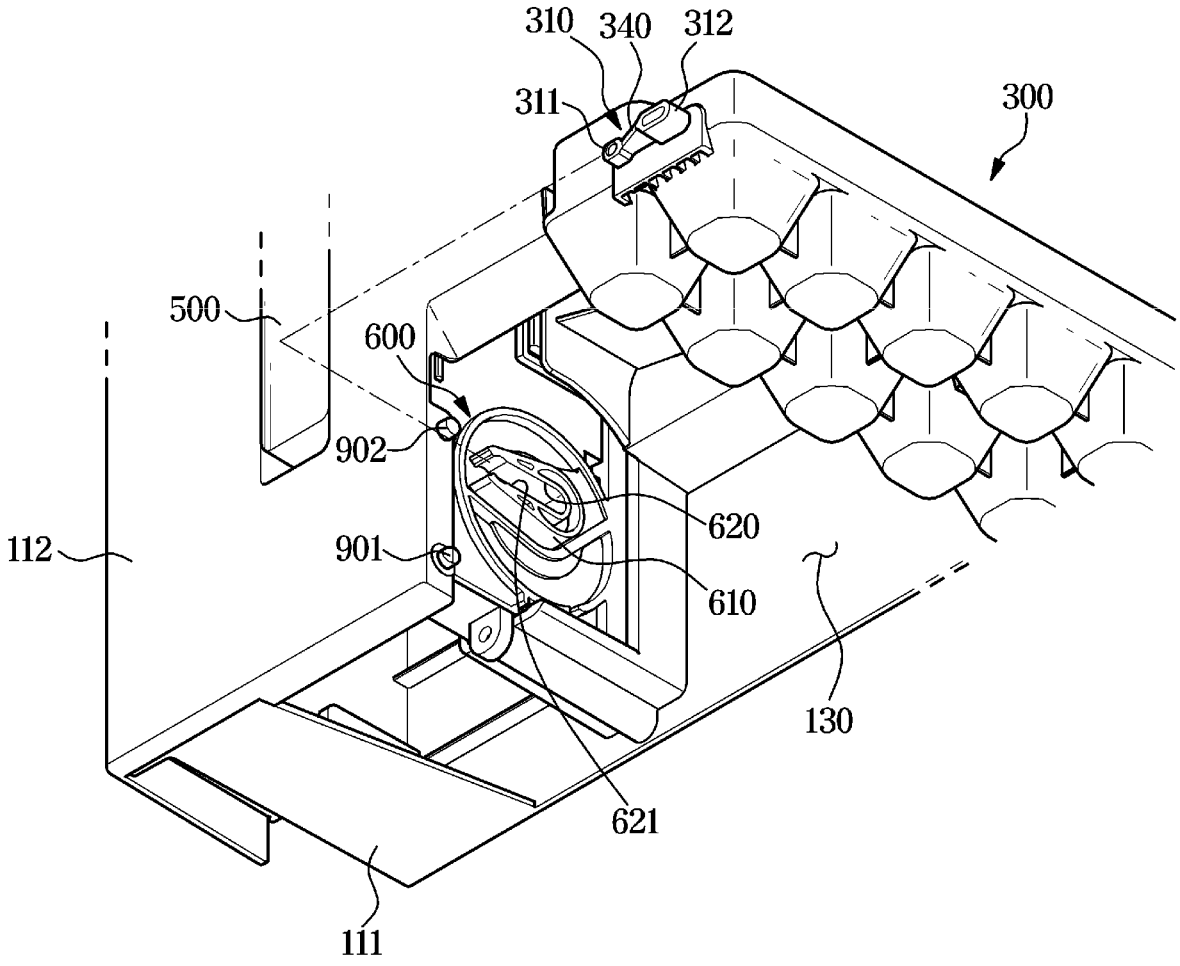
FIG. 8 is a view illustrating a shaft portion and a mounting guide portion of an ice-making tray according to an embodiment of the disclosure.
Figure 9:
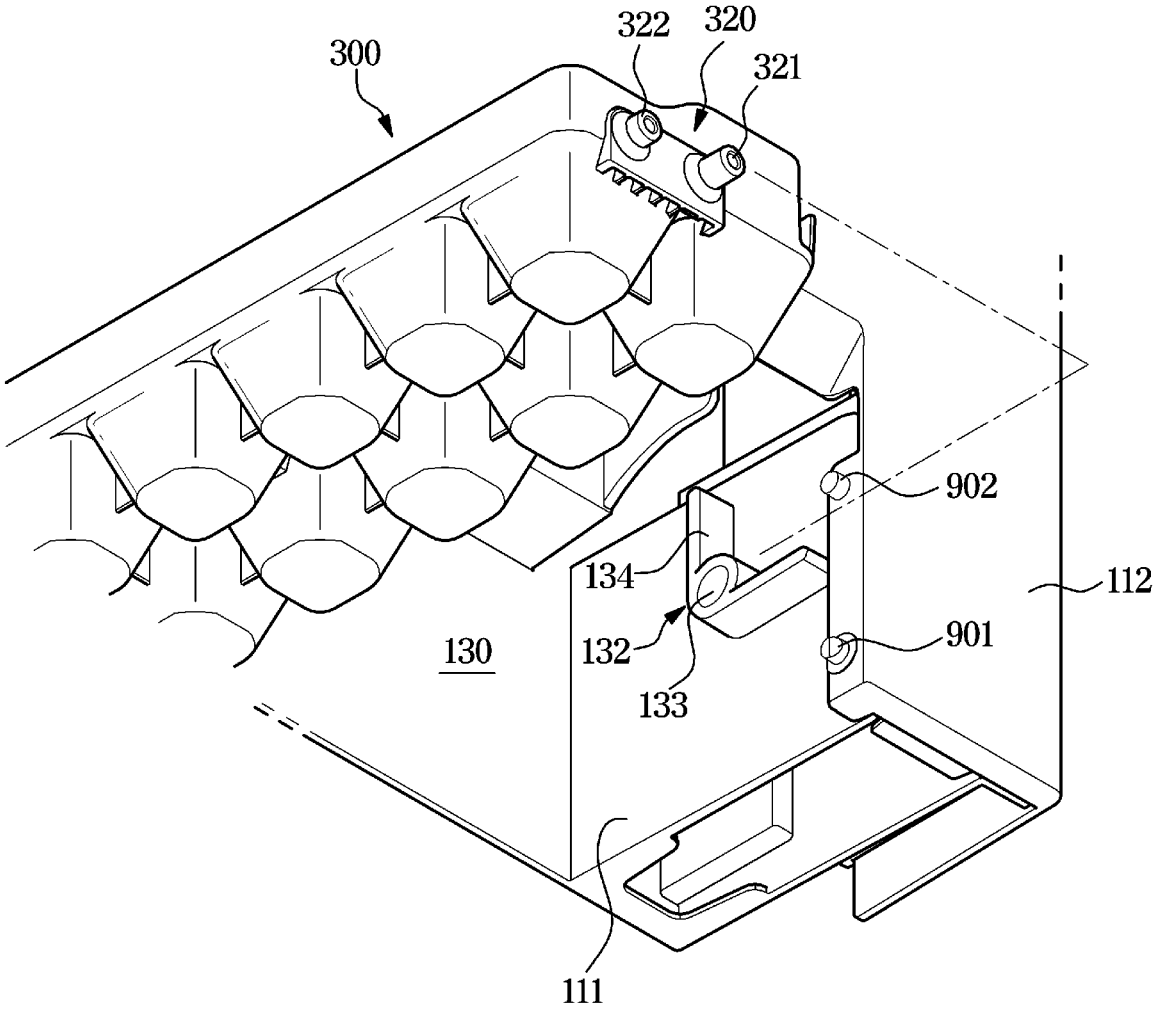
FIG. 9 is a view illustrating a rotating shaft portion of an ice-making tray mounted on an ice maker according to an embodiment of the disclosure.
Figure 10:
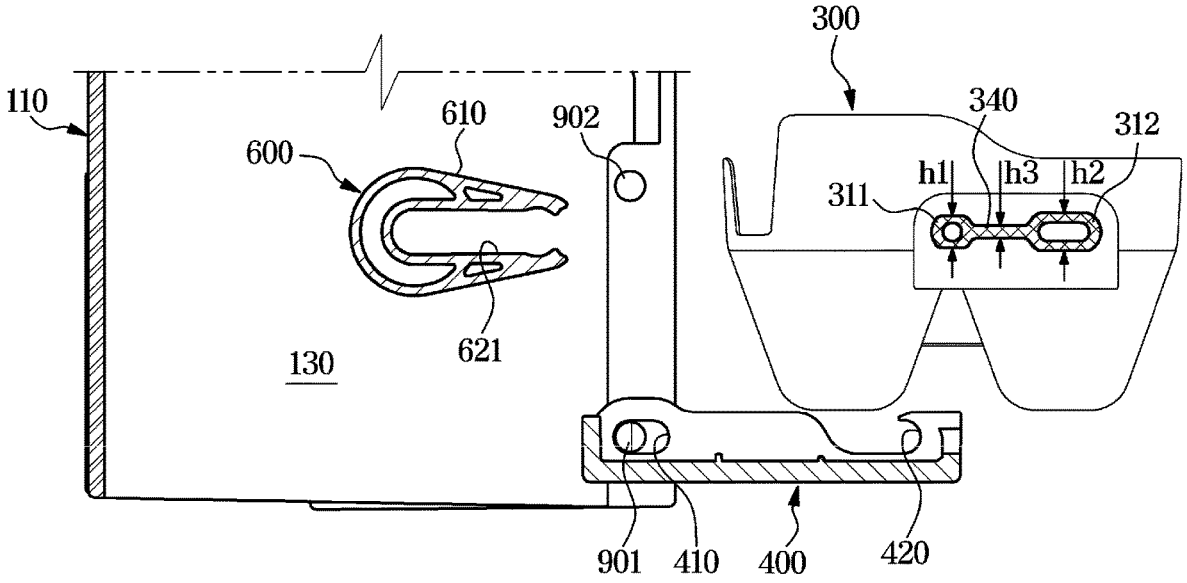
FIGS. 10 to 12 are views illustrating operations of a mounting guide portion mounted on an ice maker according to an embodiment of the disclosure.
Figure 11:
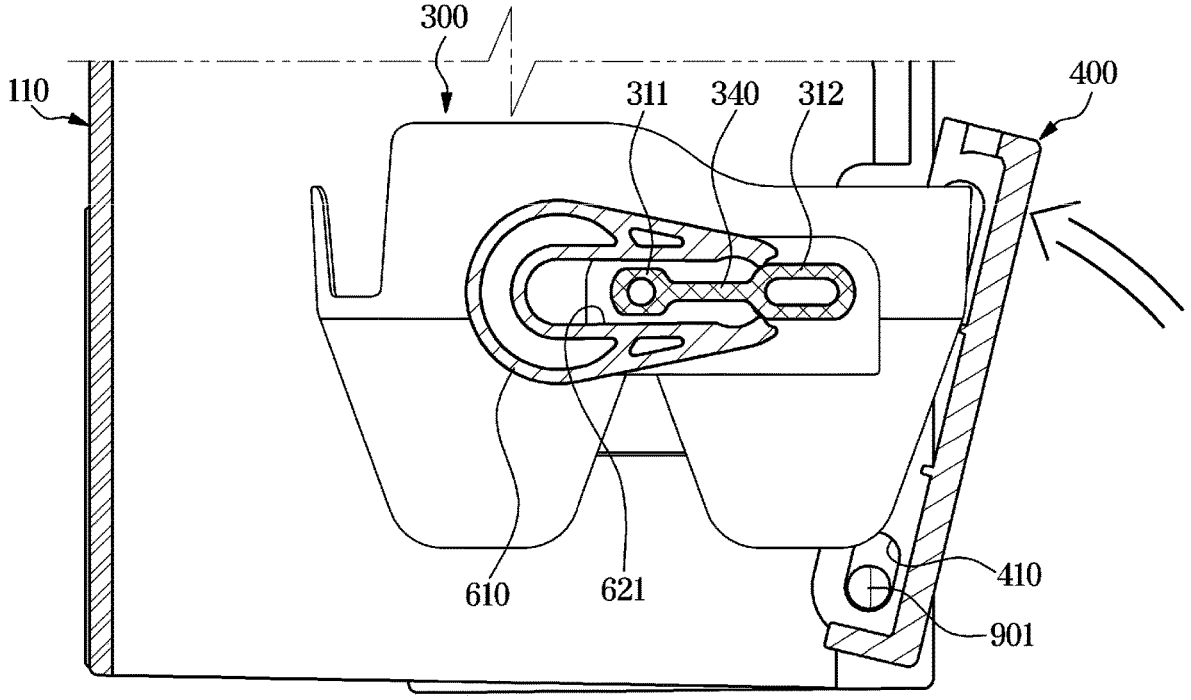
Figure 12:
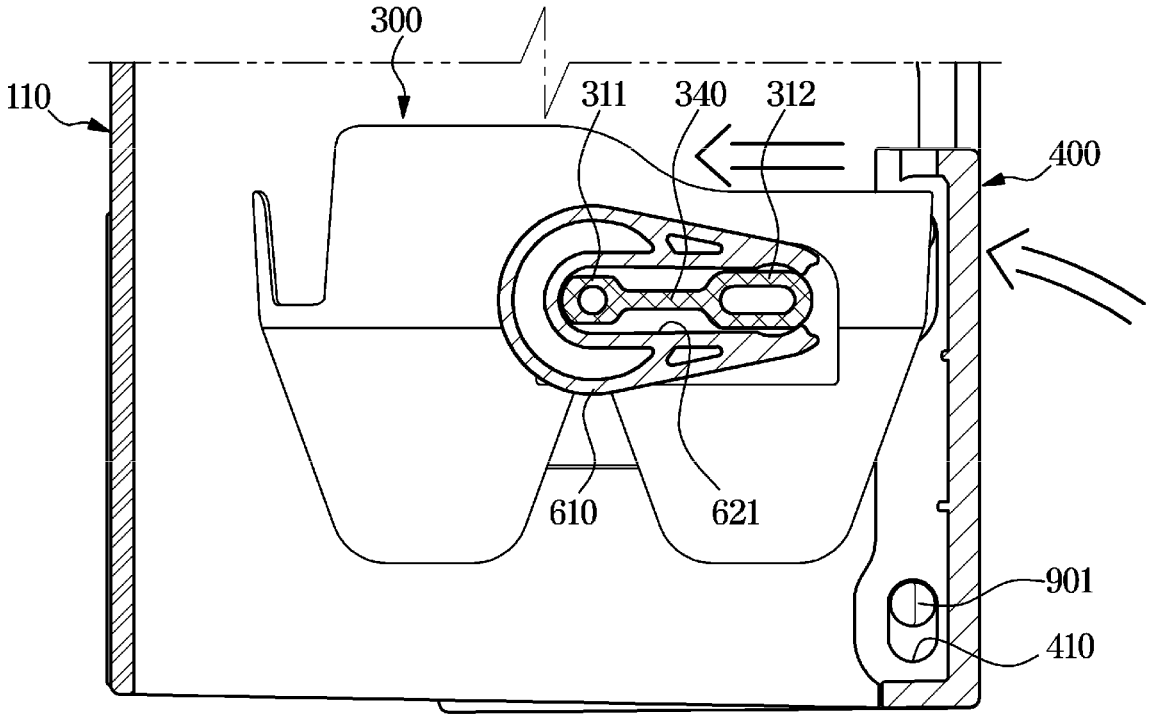

FIG. 8 is a view illustrating a shaft portion and a mounting guide portion of an ice-making tray according to an embodiment of the disclosure, FIG. 9 is a view illustrating a rotating shaft portion of an ice-making tray mounted on an ice maker according to an embodiment of the disclosure, and FIGS. 10 to 12 are views illustrating operations of a mounting guide portion mounted on an ice maker according to an embodiment of the disclosure. Reference numerals not illustrated refer to FIGS. 1 to 7.

As illustrated in FIGS. 8 to 12, the ice-making tray 300 of the ice maker 100 may be provided so that water is supplied from the water bucket 200 to form ice.

The ice-making tray 300 may include the ice-making portion 301 in which the water supplied from the water bucket 200 is received. The ice-making portion 301 may be provided as a plurality of ice-making spaces. The rotating shaft portion 320 may be provided on one side of the ice-making tray 300, and the shaft portion 310 may be provided on the other side.

The shaft portion 310 of the ice-making tray 300 may be connected to the lever 500 that is manually operated to separate the ice of the ice-making tray 300. The lever 500 may be tiltably mounted to the second frame 112. The lever 500 may be tiltably mounted to the lever receiving portion 115 of the second frame 112. The user may rotate the ice-making tray 300 by tilting the lever 500 in one direction when the ice of the ice-making tray 300 is to be separated.

The rotating shaft portion 320 of the ice-making tray 300 includes a rotating shaft 321 rotatably mounted to the rotating shaft mounting portion 132 of the first frame 111, and an interference protrusion 322 formed to be interfered by the stopper 134 of the rotating shaft mounting portion 132. The interference protrusion 322 may be formed on the rotating shaft portion 320 of the ice-making tray 300.

In the ice-making tray 300, after the interference projection 322 is caught by the stopper 134 of the first frame 111 and rotated at a predetermined angle, the ice of the ice-making tray 300 may be separated from the ice-making tray 300 by being twisted.

The connecting member 600 for connecting with the lever 500 may be provided on the other side of the ice-making tray 300. The connecting member 600 may connect between the lever 500 and the shaft portion 310 of the ice-making tray 300.

The shaft portion 310 of the ice-making tray 300 may include a first shaft 311 and a second shaft 312. The first shaft 311 and the second shaft 312 may be disposed at a predetermined interval. The shaft portion 310 of the ice-making tray 300 may be connected to the lever 500 and a gear (not shown) through the connecting member 600.

The connecting member 600 may include a link shaft 610 that is connected to the lever 500 and is rotatably provided. The connecting member 600 may include a shaft inserting portion 620 provided to connect to the shaft portion 310 of the ice-making tray 300. The shaft inserting portion 620 may be provided on the link shaft 610. The shaft inserting portion 620 may be formed with a shaft inserting groove 621 so that the shaft portion 310 of the ice-making tray 300 is inserted and connected. The shaft portion 310 of the ice-making tray 300 inserted into the shaft inserting groove 621 may be rotated by tilting the lever 500.

Therefore, when the lever 500 is tilted by the user, the ice-making tray 300 may be rotated by the shaft portion 310 and the rotating shaft 321 connected to the connecting member 600. When the ice-making tray 300 rotates at the predetermined angle, the interference protrusion 322 formed on the rotating shaft portion 320 of the ice-making tray 300 is caught by the stopper 134 of the first frame 111 so that one side of the ice-making tray 300 stops rotating. When the lever 500 is further tilted to further rotate the shaft portion 310 of the ice-making tray 300, as the rotation angle between one side and the other side of the ice-making tray 300 is different, the shape of the ice-making tray 300 is twisted and the ice received in the ice-making tray 300 may be separated from the ice-making tray 300.

In the embodiment of the disclosure, the lever 500 and the ice-making tray 300 are illustrated to be rotated by being connected by the link shaft 610, but the spirit of the disclosure is not limited thereto. For example, a structure in which the ice-making tray 300 is rotated by connecting the lever 500 and the ice-making tray 300 is not limited to the above.

The shaft portion 310 of the ice-making tray 300 may include the first shaft 311 and the second shaft 312. The ice-making tray 300 may include a mounting guide 340 for guiding engagement with the lever 500. The mounting guide 340 may be provided to connect between the first shaft 311 and the second shaft 312.

The first shaft 311 and the second shaft 312 may be formed in an elliptical shape. A first height h1 of the first shaft 311 may be formed lower than a second height h2 of the second shaft 312. The first shaft 311 may be disposed to be inserted first into the shaft inserting portion 620 before the second shaft 312 in the coupling direction of the ice-making tray 300.

The mounting guide 340 may be provided to connect between the first shaft 311 and the second shaft 312. The mounting guide 340 may be provided to have a third height h3. The third height h3 of the mounting guide 340 may be formed lower than the first height h1 of the first shaft 311. The mounting guide 340 may be provided to guide the insertion of the shaft inserting portion 620 by connecting the first shaft 311 and the second shaft 312, and to prevent incorrect insertion when the shaft portion 310 of the ice-making tray 300 is inserted into the shaft inserting groove 621 of the shaft inserting portion 620. The mounting guide 340 may prevent the shaft portion 310 of the ice-making tray 300 from being partially inserted into the shaft inserting portion 620. The difference between the rotating shaft portion 320 and the shaft portion 310 of the ice-making tray 300 can be visually confirmed by the mounting guide 340, thereby preventing the user from mistaking an assembly direction of the ice-making tray 300.

In addition, when the ice-making tray 300 is strongly pressed against the ice-making cover 400 while the shaft portion 310 of the ice-making tray 300 is partially inserted into the shaft inserting groove 621, the shaft portion 310 of the ice-making tray 300 may be completely assembled to the shaft inserting groove 621 by the mounting guide 340, thereby improving usability.

Figure 13:
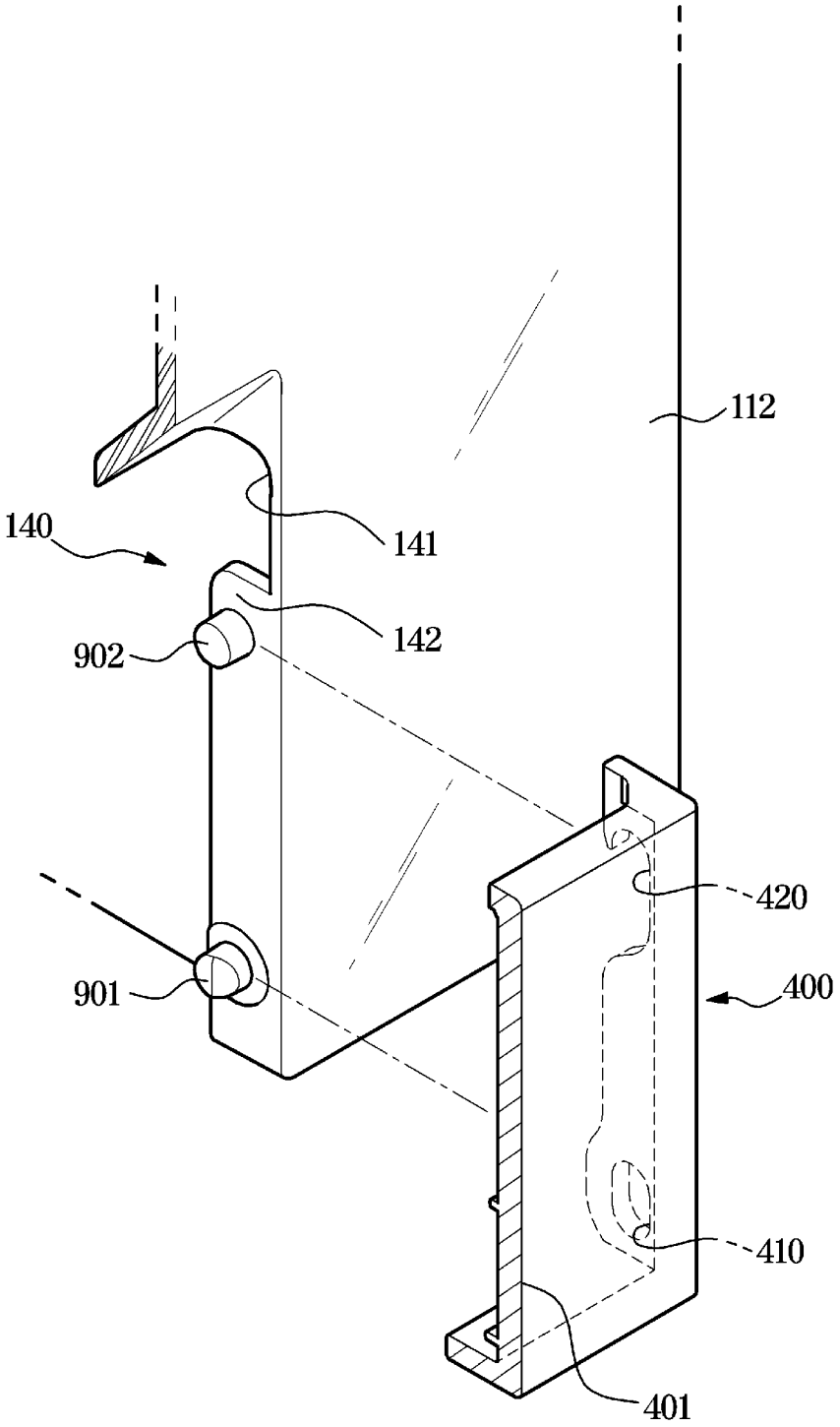
FIG. 13 is a view illustrating an ice-making cover mounted on an ice maker according to an embodiment of the disclosure.
Figure 14:
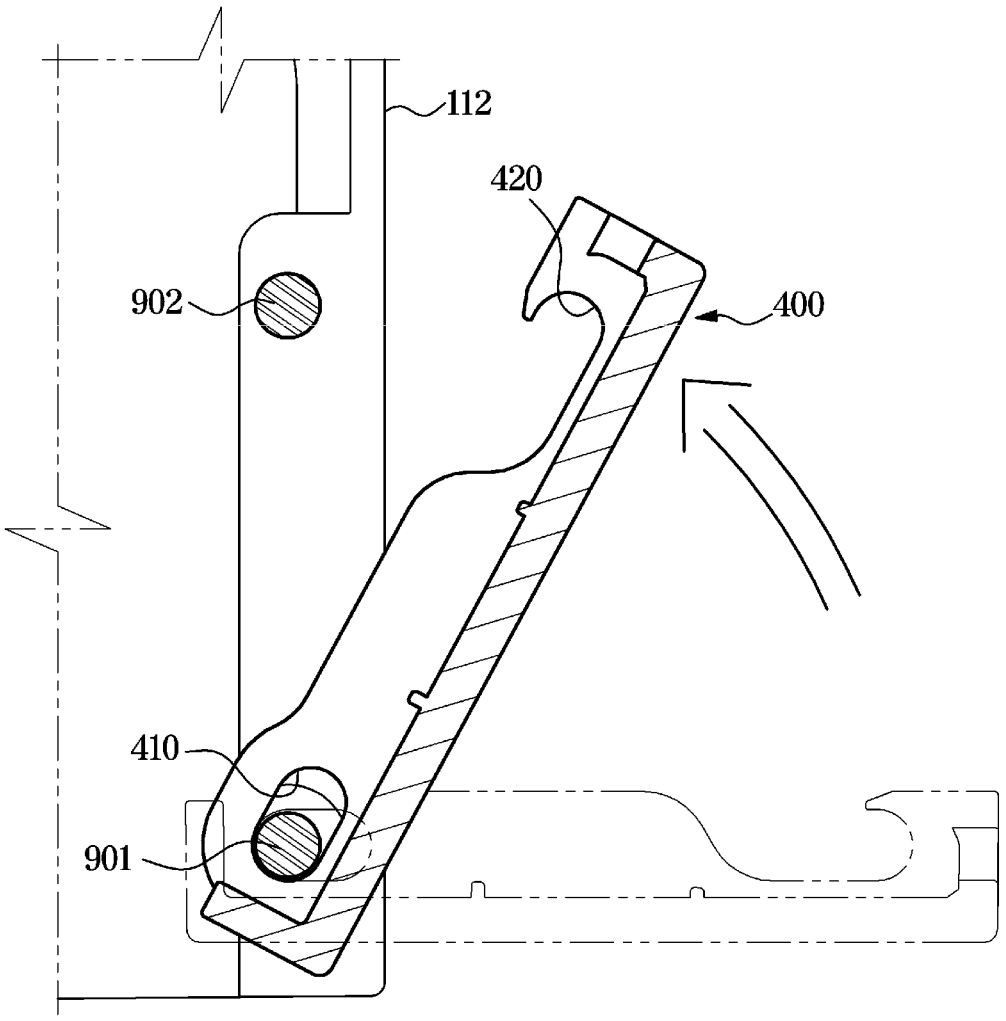
FIGS. 14 to 16 are views illustrating operations of an ice-making cover mounted on an ice maker according to an embodiment of the disclosure.
Figure 15:
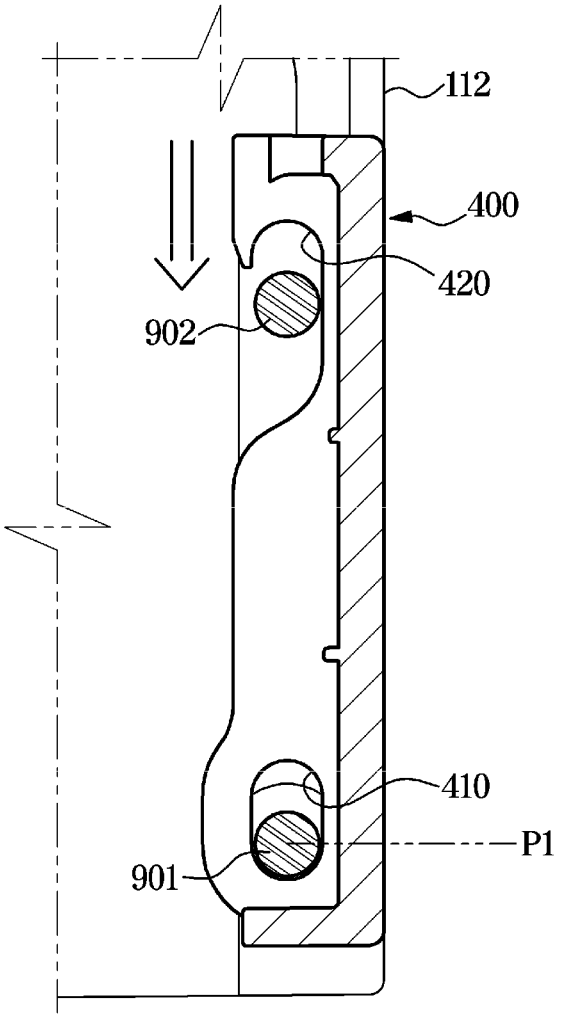
Figure 16:
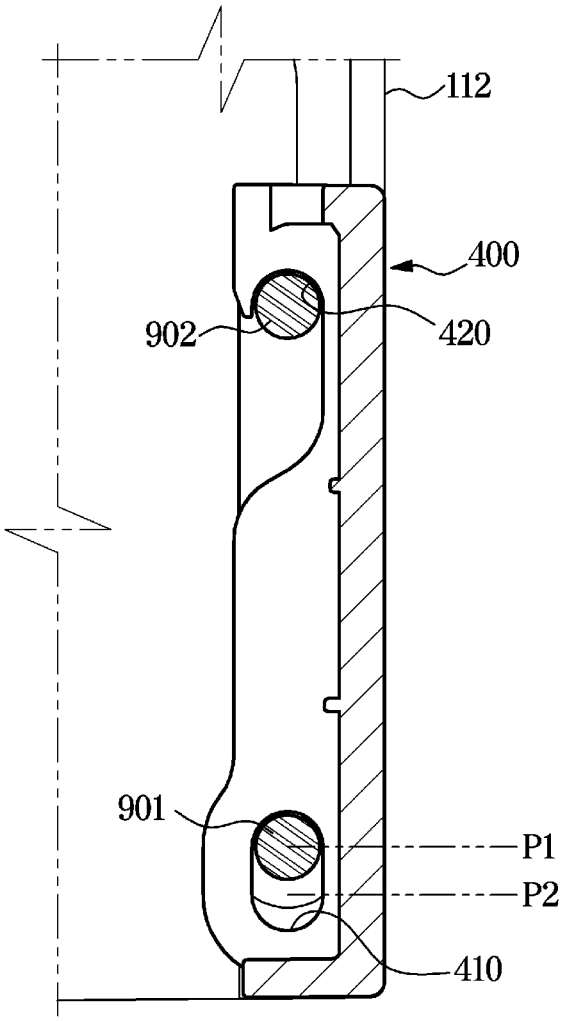

FIG. 13 is a view illustrating an ice-making cover mounted on an ice maker according to an embodiment of the disclosure, and FIGS. 14 to 16 are views illustrating operations of an ice-making cover mounted on an ice maker according to an embodiment of the disclosure. Reference numerals not illustrated refer to FIGS. 1 to 12.

As illustrated in FIGS. 13 to 16, the ice-making cover 400 may be coupled to the cover installation portion 140 of the frames 110. The ice-making cover 400 may be provided to cover the ice-making tray 300. The ice-making cover 400 may be formed in a shape corresponding to the cover installation portion 140 of the second frame 112.

The ice-making cover 400 may be provided to cover the ice-making tray 300 detachably mounted to the frames 110. The ice-making cover 400 may be provided to be opened and closed when the ice-making tray 300 is separated.

The cover installation portion 140 may be formed at a position corresponding to the tray installation portion 130 of the second frame 112. The cover installation portion 140 may include a cover installation opening 141 formed by opening at least a portion of the front surface of the second frame 112. The cover installation portion 140 may include a cover installation surface 142 extending inside the cover installation opening 141. The cover installation surface 142 may be integrally formed with the second frame 112. The cover installation surface 142 may be formed on both sides of the cover installation opening 141.

A cover rotating shaft 901 may protrude from the lower side of the cover installation surface 142, and a cover locking protrusion 902 may protrude on the upper side of the cover installation surface 142. Each of the cover rotating shaft 901 and the cover locking protrusion 902 may be formed in a cylindrical shape.

The ice-making cover 400 may be installed to open and close the cover installation portion 140 of the second frame 112. The ice-making cover 400 may be provided with an ice-making cover body 401, a cover rotating shaft inserting portion 410 and a cover locking portion 420 corresponding to the cover rotating shaft 901 and the cover locking protrusion 902 of the cover installation portion 140. The cover rotating shaft inserting portion 410 of the ice-making cover 400 may be formed so that the cover rotating shaft 901 can be coupled.

The cover rotating shaft inserting portion 410 may be located under the ice-making cover 400. The cover rotating shaft 901 corresponding to the cover rotating shaft inserting portion 410 may be located under the frames 110. The ice-making cover 400 may be rotated around the cover rotating shaft 901 coupled to the cover rotating shaft inserting portion 410 and may be provided to open and close the cover installation portion 140.

The cover rotating shaft inserting portion 410 may be formed as a long hole. The cover rotating shaft inserting portion 410 may be rotatably installed on the cover rotating shaft 901. The cover rotating shaft inserting portion 410 may be formed to move the ice-making cover 400 in the vertical direction relative to the cover rotating shaft 901.

The cover rotating shaft inserting portion 410 of the ice-making cover 400 coupled to the cover rotating shaft 901 of the frames 110 is formed in the long hole and is rotatable with respect to the cover rotating shaft 901 and is provided to be slidably moved at predetermined intervals.

The cover locking portion 420 of the ice-making cover 400 may be formed to correspond to the cover locking protrusion 902 of the frames 110. The cover locking portion 420 may be located on the top of the ice-making cover 400. The cover locking protrusion 902 corresponding to the cover locking portion 420 may be located on the top of the frames 110. The ice-making cover 400 may be fixed to the frames 110 by being caught by the cover locking portion 420 in the cover locking protrusion 902. The cover locking portion 420 may include a groove or a slit shape that is recessed upward. The cover locking portion 420 may be moved to the upper or lower side of the ice-making cover 400 to be locked or separated from the cover locking protrusion 902.

The ice-making cover 400 may be moved upward or downward by the cover rotating shaft inserting portion 410 and the cover rotating shaft 901 on the lower side. The ice-making cover 400 may be provided to open and close the cover installation portion 140 at a first position P1 in which the lower portion of the cover rotating shaft inserting portion 410 is located in the cover rotating shaft 901. In the first position P1, the ice-making cover 400 may be rotated around the cover rotating shaft 901 because the cover locking portion 420 is not caught in the cover locking protrusion 902.

The cover installation portion 140 may be covered at a second position P2 where the upper portion of the cover rotating shaft inserting portion 410 of the ice-making cover 400 is located at the cover rotating shaft 901. In the second position P2, the ice-making cover 400 may be closed because the cover locking portion 420 is caught in the cover locking protrusion 902.

By moving the ice-making cover 400 of the closed state on the frames 110 upward and rotating the ice-making cover 400 to open, it is possible to improve the usability by allowing the ice-making cover 400 to open and close more stably.

According to the embodiments of the disclosure, it is possible to improve consumer usability by improving a mounting structure of an ice maker.

In addition, it is possible to improve consumer usability by improving a mounting structure of the water bucket and a mounting structure of the ice-making tray.

In addition, it is possible to improve a cover structure so that the cover can be closed even when the ice-making tray is inserted.

While the disclosure has been illustrated and described with reference to various embodiments thereof, it will be understood by those skilled in the art that various changes in form and details may be made therein without departing from the spirit and scope of the disclosure as defined by the appended claims and their equivalents.

What is claimed is:

1. A refrigerator comprising:

a main body in which a storage chamber is formed;

a door configured to open and close the storage chamber; and an ice maker installable in the door, wherein the ice maker comprises:

a frame, an ice-making tray, which is couplable to and decouplable from the frame, configured to contain ice, and a water bucket, which is rotatable while mounted on the frame, configured to supply water to the ice-making tray, wherein the water bucket comprises:

a rotating shaft as a rotation center about which the water bucket is rotatable while mounted on the frame, and a moving guide spaced apart from the rotating shaft and movable around the rotating shaft, and wherein the frame comprises:

a rotating shaft coupling portion to which the rotating shaft is rotatably coupled, and a guide rail including an exterior surface on which the moving guide is supported, wherein the exterior surface of the guide rail is formed in a shape of a movement path of the moving guide of the water bucket to guide a rotational movement of the water bucket, and an ice-making cover configured to cover the ice-making tray, and a cover rotating shaft configured to be provided to couple the ice-making cover, and wherein the ice-making cover comprises a cover rotating shaft inserting portion formed as a hole to allow the cover rotating shaft to be movably coupled along a vertical direction of the cover rotating shaft inserting portion.

2. The refrigerator according to claim 1, wherein the water bucket comprises a water bucket body with one surface open to supply the water, and a water bucket cover formed on another surface of the water bucket body, and wherein the rotating shaft and the moving guide are configured to be provided on both sides of the water bucket body.

3. The refrigerator according to claim 2, wherein the frame comprises a water bucket installation portion to which the water bucket is couplable, and wherein the rotating shaft coupling portion and the guide rail are configured to be provided on both inner sides of the water bucket installation portion.

4. The refrigerator according to claim 3, wherein the water bucket cover further comprises a frame support portion configured to be formed to extend at the bottom thereof and configured to be supported on at least one surface of the water bucket installation portion.

5. The refrigerator according to claim 1, wherein the rotating shaft coupling portion and the guide rail are configured to be formed integrally.

6. The refrigerator according to claim 1, wherein the guide rail further comprises a seating portion formed to limit a movement of the moving guide while the water bucket is mounted on the frame.

7. The refrigerator according to claim 1, wherein the rotating shaft coupling portion and the guide rail are configured to be open in a mounting direction of the water bucket so that the water bucket is separable from the frame.

8. The refrigerator according to claim 1, wherein the frame comprises a water bucket receiving portion configured to receive the water bucket, and wherein the water bucket receiving portion comprises an inclined surface configured to be inclined so that the water in the water bucket is guided to the ice-making tray.

9. The refrigerator according to claim 1, further comprising:

a lever configured to be manipulated to separate the ice from the ice-making tray, wherein the ice-making tray comprises a mounting guide configured to guide engagement with the lever.

10. The refrigerator according to claim 9, wherein the lever comprises a connecting member provided with a shaft inserting portion to rotatably connect the ice-making tray.

11. The refrigerator according to claim 10, wherein the ice-making tray comprises:

a shaft portion connected to the shaft inserting portion of the lever, and a rotating shaft portion rotatably connected to the frame, and wherein the mounting guide is configured to be provided on the shaft portion.

12. The refrigerator according to claim 11, wherein the shaft portion comprises a first shaft having an elliptical shape, and a second shaft having an elliptical shape spaced apart from the first shaft, and wherein the mounting guide is configured to connect between the first shaft and the second shaft.

13. The refrigerator according to claim 12, wherein the first shaft has a first height h1, wherein the second shaft has a second height h2 higher than the first height h1, and wherein the mounting guide has a third height h3 lower than the first height h1.

14. The refrigerator according to claim 1, wherein the ice-making cover is movable in the vertical direction along the cover rotating shaft inserting portion while the cover rotating shaft is coupled to the cover rotating shaft inserting portion, wherein, while the cover rotating shaft is located at a first position while coupled to the cover rotating shaft inserting portion, the ice-making cover is configured to be rotatable around the cover rotating shaft, and wherein, while the cover rotating shaft is located at a second position while coupled to the cover rotating shaft inserting portion, the ice-making cover is configured to be fixed to the frame.

15. A refrigerator comprising:

a main body configured to accommodate a storage chamber;

a door provided in the main body, configured to open and close the storage chamber; and an ice maker mountable on the door, wherein the ice maker comprises:

a frame, an ice-making tray including a shaft on one side and a rotating shaft portion on another side, the ice-making tray being configured to be couplable to and decouplable from the frame, and a lever connected to the ice-making tray, the lever being configured to be manipulated to separate ice from the ice-making tray, wherein the lever comprises a connecting member provided with a shaft inserting portion, configured to rotatably connect the ice-making tray, and wherein the ice-making tray comprises a mounting guide provided on the rotating shaft portion, and the mounting guide is formed to be inserted into the shaft insertion portion of the connecting member and have a height lower than a height of the rotating shaft portion to guide engagement of the ice-making tray with the lever.

16. The refrigerator according to claim 15, wherein the rotating shaft portion comprises a first shaft having an elliptical shape, and a second shaft having an elliptical shape spaced apart from the first shaft, and wherein the mounting guide is configured to connect between the first shaft and the second shaft.

17. The refrigerator according to claim 15, wherein the first shaft has a first height h1, the second shaft has a second height h2 higher than the first height h1, and the mounting guide has a third height h3 lower than the first height h1, and wherein the first height h1, the second height h2, and the third height h3 are configured to be formed at different heights.

18. The refrigerator according to claim 15, further comprising:

a water bucket which is rotatable while mounted on the frame, configured to supply water to the ice-making tray, wherein the water bucket comprises:

a rotating shaft as a rotation center about which the water bucket is rotatable while mounted on the frame, and a moving guide spaced apart from the rotating shaft and movable around the rotating shaft, and wherein the frame comprises:

a rotating shaft coupling portion to which the rotating shaft is rotatably coupled, and a guide rail including an exterior surface on which the moving guide is supported, wherein the exterior surface of the guide rail is formed in a shape of the movement path of the moving guide of the water bucket to guide a rotational movement of the water bucket.

19. The refrigerator according to claim 15, wherein the rotating shaft coupling portion and the guide rail are configured to be formed integrally.

* * * * *